United States Patent [19]

Williams

[11] Patent Number: 4,470,366

[45] Date of Patent: Sep. 11, 1984

[54] CONTINUOUS SINGLE FLAP HINGE AND SEAL DEVICE FOR FLEXIBLE HYDROFOILS AND THE LIKE

[75] Inventor: John W. Williams, Bellevue, Wash.

[73] Assignee: The Boeing Company, Seattle, Wash.

[21] Appl. No.: 428,601

[22] Filed: Sep. 30, 1982

[51] Int. Cl.[3] ..... B63B 1/28

[52] U.S. Cl. ..... 114/280; 244/215

[58] Field of Search ..... 114/274, 275, 276, 277, 114/280, 281; 244/39, 75 R, 213, 214, 215, 219, 131, 90 R; 16/225, 235

[56] References Cited

U.S. PATENT DOCUMENTS

| | | | |
|---|---|---|---|
| 3,140,066 | 7/1964 | Sutton et al. | 244/215 |
| 4,335,671 | 6/1982 | Warner et al. | 114/274 |
| 4,345,538 | 8/1982 | Warner et al. | 114/274 |

*Primary Examiner*—Trygve M. Blix
*Assistant Examiner*—Jesûs D. Sotelo
*Attorney, Agent, or Firm*—Hughes, Barnard & Cassidy

[57] ABSTRACT

A continuous flap hinge and sealing device for hingedly connecting a control flap (45) to the trailing edge (46) of a flexible fluid foil (41) comprising a span-wise hinge block (52) having a continuous comb-like hinge member interconnected with a comparable comb-like hinge member (50) integral with the foil trailing edge (46) and defining alternating interdigitated hinge elements (51, 54) secured together by a span-wise continuous hinge pin (55) and wherein such continuous hinge block (52) is received within a continuous span-wise leading edge slot (56) formed in the flap leading edge (48) with the flap leading edge being fixedly secured to the hinge block (52) at two span-wise spaced inboard and outboard points ("X", "Y") defining "hard" pivotal connections wherein relative movement between the hinge block (52) and flap (45) is retrained; yet, wherein fore and aft relative sliding movement of the hinge block (52) within the flap leading edge slot (56) is permitted at all span-wise points intermediate the two "hard" points ("X", "Y") of pivotal connection, as well as inboard and outboard thereof. Further, the hinge elements (50, 52, 55), although rigidly secured to the flap (45) at only two spaced span-wise points ("X", "Y"), nevertheless extend continuously through the span-wise length of the hinged connection; and, together with the flap leading edge (48), define a continuous span-wise labyrinth seal which effectively precludes bleeding of boundary layer fluid.

5 Claims, 10 Drawing Figures

FIG. 1
PRIOR ART
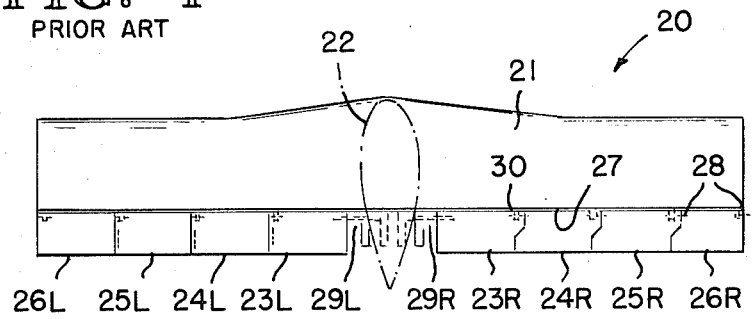
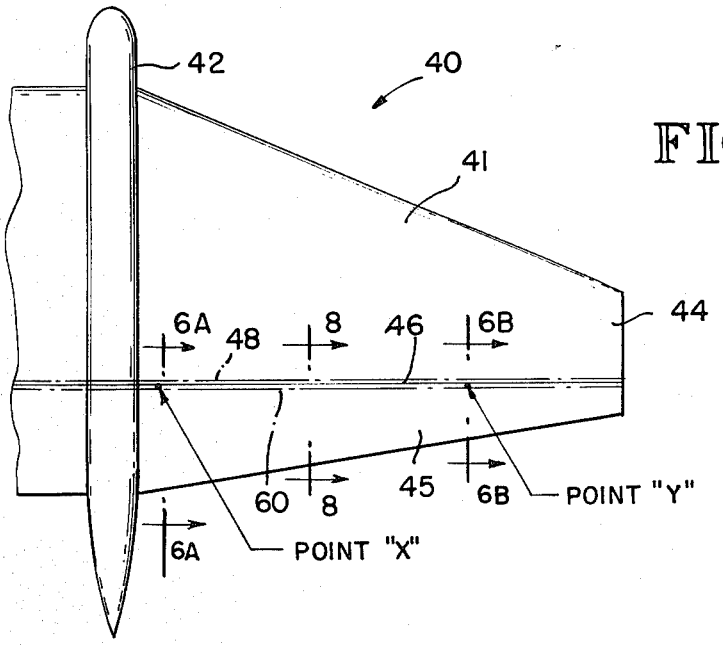
FIG. 2
FIG. 3
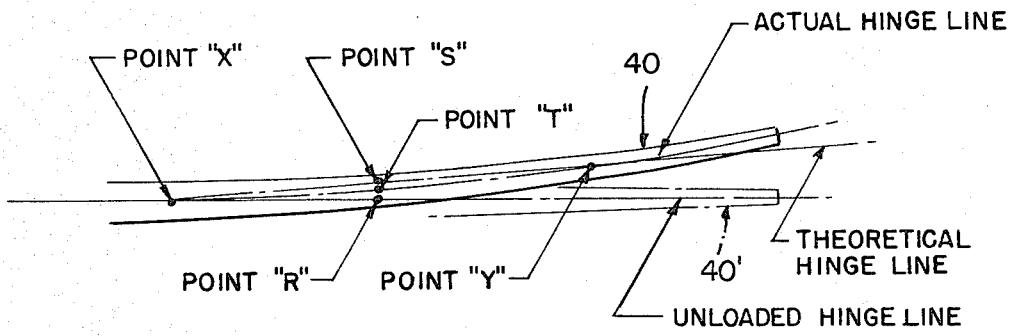

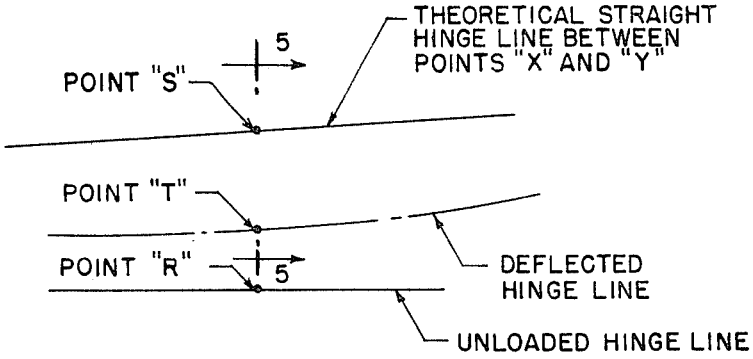
FIG. 4
FIG. 5
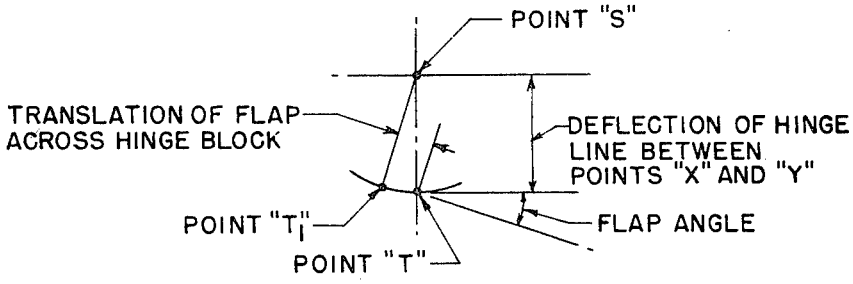
FIG. 6
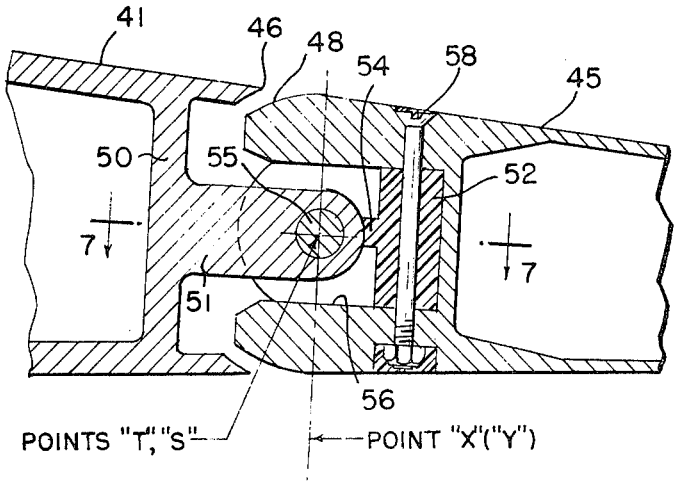

FIG. 8
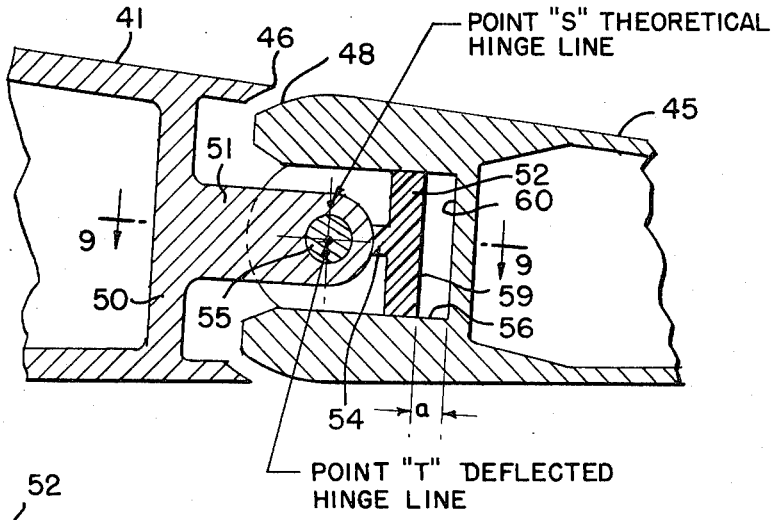
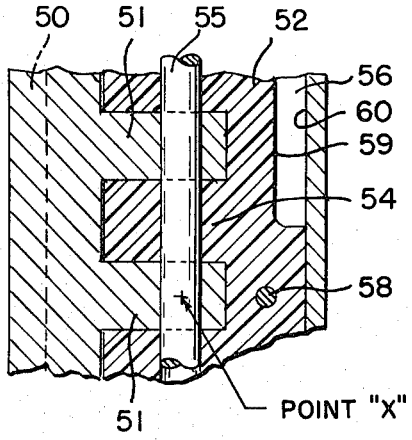
FIG. 7
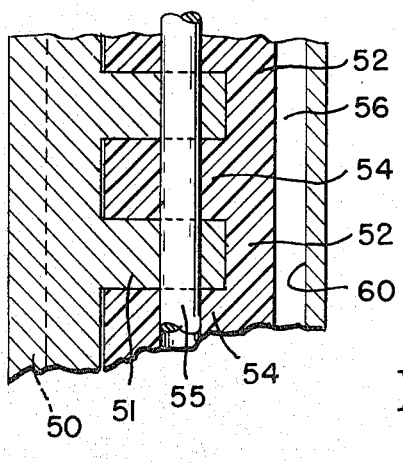
FIG. 9
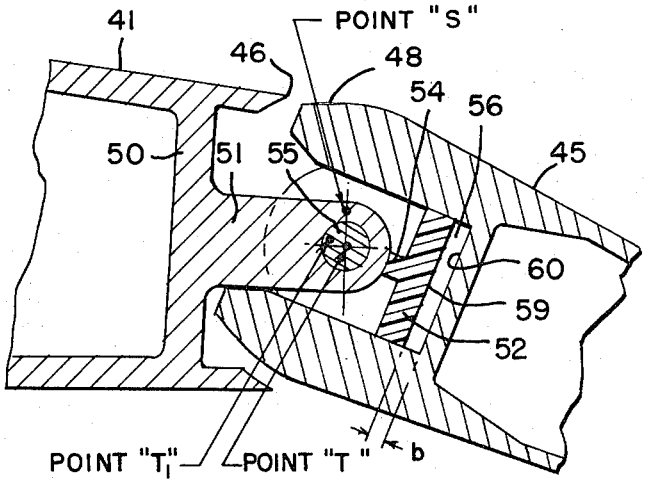
FIG. 10

CONTINUOUS SINGLE FLAP HINGE AND SEAL DEVICE FOR FLEXIBLE HYDROFOILS AND THE LIKE

BACKGROUND OF THE INVENTION

1. Field of the Invention

The present invention relates in general to flaps such, for example, as control flaps of the type which are conventionally hingedly connected to the trailing edge of a stationary foil on a vessel—e.g., a hydrofoil vessel or the like—and, more particularly, to an improved hinge construction for pivotally connecting such a flap to the foil trailing edge and which permits hinged mounting of a single longitudinally extending flap along the entire extent of the foil trailing edge, or along any desired substantial portion thereof; yet, wherein the flap may be freely pivoted about its longitudinal hinged connection to the foil irrespective of deflection of the foil, flap and hinged connection due to fluid loading thereof. Stated differently, the invention pertains to a simple, yet highly effective, hinge connection which readily permits of pivotal movement of the longitudinally extending flap along the entire extent of the hinged connection thereof to the foil irrespective of foil/flap deflection and irrespective of the fact that such deflection results in establishment of a curvilinear foil trailing edge and, therefore, a curvilinear hinge line.

2. Background Art

It has long been recognized that trailing edge flaps for vessel control—particularly, for control of hydrofoil ships—are desirable and, indeed, often essential in order to permit reliable controlled maneuverability of the vessel; and, consequently, it has been a common practice to hingedly connect a plurality of such trailing edge flaps to the trailing edge of a foil with the leading edge of the flaps spaced from, but in close proximity to, the trailing edge of the foil. In such arrangements, it is also generally common for adjacent flaps to be interconnected in end-to-end fashion with each flap serving to drive at least one adjacent flap and with each flap (except for that flap or those flaps directly connected to external drive mechanisms) being driven by an adjacent flap. However, regardless of whether any given flap is functioning as a drive flap, a driven flap, or both, its leading edge is generally hingedly connected to the foil trailing edge at two points spaced apart in a span-wise direction; and, at those points of hinged connection, the flap leading edge and foil trailing edge will generally be deflected in like amounts and in unison by the pressure of the fluid through which the vessel is moving. Consequently, in these localized spaced regions of "hard" pivotal connection, it is theorectically possible and relatively simple to design mating edge contours which permit relative pivotal movement between the flap and foil without interference.

Unfortunately, however, in those regions of the mating flap leading edge and foil trailing edge which are located between the span-wise spaced hinge points of "hard" connection, dynamic conditions are such that in operation the pressure of the fluid medium through which the vessel is passing serves to cause significant deflection of both the foil (and its trailing edge) and the flap (and its leading edge). While the degree of deflection between such foil trailing edge and flap leading edge is substantially the same at the spaced "hard" points of hinged connection therebetween, in the "soft" regions intermediate such spaced "hard" points the degree of deflection between the two edges can be, and often is, significantly different.

Indeed, when dealing with a foil having a free tip that is not directly and positively connected to the vessel structure, the relative deflections of the flap leading edge and the foil trailing edge can be in opposite directions. For example, assuming that the vessel is a hydrofoil ship moving through the water and that the trailing edge control flap(s) is (are) shifted through a downward or negative angle of rotation for the purpose of improving lift and/or controlling maneuverability, those skilled in the art will appreciate that fluid pressure applied to the bottom surfaces of the flap/foil combination will cause the outer tip of the foil to be deflected upwardly to a greater extent than inboard regions thereof, thus producing a foil trailing edge contour that is slightly concave rather than linear. Considering any given flap having its leading edge hingedly connected to such concave foil trailing edge at two spaced span-wise points, it will be appreciated that at the two points of "hard" or hinged connection, the flap leading edge will move with the foil trailing edge and, hence, at those two points there is little, if any, tendency for interference between the flap and foil when the flap is pivoted. But, intermediate those two points, as well as inboard and/or outboard thereof, fluid pressure exerted by the water through which the vessel is moving will be applied directly to the undersurface of that flap, causing the flap and its leading edge to be deflected upwardly in the intermediate unrestrained region of the flap. That is, the central portion of the flap leading edge will be cambered or bowed upwardly so that the flap leading edge assumes a somewhat convex shape in the region of the concave foil trailing edge, thus causing interference between the two edges with resultant reduction in fatigue life thereof. A somewhat similar result occurs even when the two edges are deflected in the same direction since the two edges will tend to be deflected by different amounts, particularly at the mid-point of the flap leading edge.

The foregoing differential deflection problems, particularly in the "soft" hingedly connected regions of the flap/foil combination intermediate two span-wise spaced "hard" pivotal connections, have, for a long period of time, presented severe design problems for foil designers. Indeed, despite the long outstanding need for an effective flap/foil combination employing only a single flap, the foregoing problems have resulted in a "solution" wherein virtually all flap/foil combinations employ multiple side-by-side flaps, each of which is hingedly connected to the trailing foil edge at two span wise spaced "hard" pivotal connection points, together with all of the necessary and attendant drive interconnections and actuating mechanisms for adjacent flaps. Not only do such systems result in increased weight, cost and complexity, but, moreover, they present serious sealing problems with regard to prevention of bleed fluid passing through the gaps between the foil trailing edge and flap leading edge. And, moreover, despite the use of multiple side-by-side adjacent flaps each having a relatively short span-wise length and each hingedly connected to the foil trailing edge at two spaced span-wise "hard" pivotal connection points, the problems of differential deflection and interference between the mating flap and foil edges have persisted.

Prior to the advent of the present invention, various attempts have been made to solve the problems introduced by varying discontinuities at the junction of the flap leading edge and the foil trailing edge. One such attempt has involved the use of adjustable flap hinges; an approach involving cumbersome and expensive assembly procedures requiring the use of separate shims. Unfortunately, during routine periodic maintenance there is a distinct possibility that one or more of such shims will be removed and will not be replaced or, if replaced, will be improperly positioned, thereby promoting flap/foil interference, reducing fatigue life, increasing drag, and decreasing flap effectivity. Moreover, fatigue life of the foil is further severely reduced because such adjustable hinge connections introduce undesired stress concentrations at localized points.

A second approach that has been employed, but which has been found to be entirely unsatisfactory, has been that of simply providing a sufficiently large gap or discontinuity at the hinged connections and, therefore, along the juncture of the flap leading edge and foil trailing edge in the span-wise spaces intermediate, inboard of, and outboard of the "hard" hinged connections, so that flap/foil interference is precluded even under those operating conditions when the edges are subjected to maximum differential deflection. Although this approach has eliminated the problems of reduced fatigue life, cost, and difficulties in assembly procedures, at the same time the excessively large discontinuities or gaps have further increased drag and reduced flap effectivity.

Exemplary of the prior art approaches are those disclosures found in Cone, U.S. Pat. No. 2,152,029; Roeseler et al., U.S. Pat. No. 4,213,587; Feifel, U.S. Pat. No. 4,305,177; Warner et al., U.S. Pat. No. 4,335,671. Thus, each of the foregoing patents is illustrative of prior art approaches employing segmented flaps. In the Roeseler et al, Feifel and Warner et al patents, the adjacent flap segments are each hingedly connected to the foil trailing edge at two span-wise spaced "hard" connection points with each such "hard" connection being shared by two adjacent flaps; and, with the flaps being interconnected along their adjacent edges for mutual drive purposes. Nevertheless, as recognized in the Warner et al patent, the points of "soft" hinged connection between adjacent points of "hard" connection still produce flap/foil interference when the flap is actuated; and, to solve that problem, the patentees provide for a special flap leading edge contour in which the flap leading edge is "drifted" back relative to the axis of flap rotation so as to increase the gap between the flap/foil combination in the "soft" regions of hinged connection.

Efforts to provide arrangements enabling the use of a single flap are disclosed in Sutton et al., U.S. Pat. No. 3,140,066 and Clark, British Pat. No. 734,959. Thus, in the Clark construction the flap is coupled to the foil trailing edge by means of a plurality of circular sliding blocks which are capable of relative fore/aft movement with respect to the foil trailing edge. However, such sliding devices are located at span-wise discrete locations and provide poor support, particularly in the case of hydrofoils which are subjected to high load conditions. The construction inherently produces concentrated load points and requires complex close tolerance fabrication operations. Similarly, in the Sutton et al patent, it is proposed that a plurality of span-wise "hard" hinged connections permit of relative fore/aft movement between the flap and foil. Again, the device is subject to concentrated loads, requires stress risers in the flap and foil structures, and fails to provide for proper sealing between the upper and lower aerodynamic control surfaces.

SUMMARY OF THE INVENTION

A composite, continuous, single flap hinge and sealing device is disclosed for hingedly connecting a control flap to the trailing edge of a flexible fluid foil which may be of the type which is unsupported at its tip end and which is subject to deflection as the result of imposed fluid loads and wherein such device comprises a span-wise hinge block defining means comprising a continuous comb-like hinge member which is interconnected with a comparable comb-like hinge member integral with the foil trailing edge, with the two comb-like hinge members defining alternating interdigitated hinge elements secured together by means of a span-wise continuous hinge pin or the like, and wherein such continuous hinge block is received within a continuous span-wise leading edge slot formed in the flap leading edge with the flap leading edge being fixedly secured to the hinge block at two span-wise spaced inboard and outboard points defining "hard" pivotal connections wherein relative movement between the hinge block and flap is restrained; yet, wherein fore and aft relative sliding movement of the hinge block within the flap leading edge slot is permitted at all span-wise points intermediate the two "hard" points of pivotal connection, as well as inboard and outboard thereof, thereby permitting relative fore and aft translation between the flap and hinge block at such points during pivotal flap movement about a curvilinear hinge line resulting from flap/foil deflection under the influence of fluid loads.

More specifically, it is a general aim of the present invention to provide an improved hinge construction for use with fluid foils such, for example, as hydrofoils, and which permits the use of a single span-wise extending flap secured to the hinge device at two span-wise spaced points and which is free to move relative to the hinge device at all other span-wise points so that when the flap is pivoted about a curvilinear hinge line resulting from fluid loading of the foil, the flap is free to slide in a fore/aft direction relative to the hinge device with flap/foil interference resulting from pivotal movement about a curved hinge line being precluded by such relative sliding movement.

In another of its important aspects, it is an object of the invention to provide an improved hinge construction of the foregoing character wherein the hinge elements, although rigidly secured to the flap at only two spaced span-wise points, nevertheless extend continuously through the span-wise length of the hinged connection; and, together with the flap leading edge, define a continuous span-wise labyrinth seal which effectively precludes bleeding of boundary layer fluid between the upper and lower surfaces of the flap/foil combination along the hinge line.

Although the present invention finds particularly advantageous use in connection with flap/foil combinations as used on hydrofoil vessels and the like and will, therefore, be described in such an environment, those skilled in the art will readily appreciate as the ensuing description proceeds that the invention is not so limited and may find advantageous application in other environments such, for example, as control flaps on the trailing edges of airfoils used with aircraft.

DESCRIPTION OF THE DRAWINGS

These and other objects and advantages of the present invention will become more readily apparent upon reading the following detailed description and upon reference to the attached drawings, in which:

FIG. 1 is a plan view of a typical prior art multiple flap hydrofoil construction of the type that is used on the forward strut of a hydrofoil vessel and employing a conventional flap/foil hinge arrangement;

FIG. 2 is a fragmentary diagrammatic plan view here illustrating a hydrofoil flap construction made in accordance with the present invention and employing only a single control flap along the trailing edge of the foil;

FIG. 3 is an enlarged diagrammatic rear elevational view of the hydrofoil depicted in FIG. 2, but illustrating the hydrofoil in a deflected position such as might exist when the foil is subjected to loading as it moves through water, and, illustrating particularly, the unloaded flap hinge line when the hydrofoil is not deflected, the actual deflected hinge line when the hydrofoil is subjected to loading, and a theoretical linear hinge line as might exist between two spaced points comprising two "hard" hinge connections between a single flap and the hydrofoil;

FIG. 4 is a highly diagrammatic view illustrating the kinematics of vertical translation of the point about which the flap must rotate at a point intermediate the spaced "hard" hinge connections to the hydrofoil as a result of deflection of the hydrofoil under load conditions;

FIG. 5 is a diagrammatic view taken substantially along the line 5—5 in FIG. 4, here illustrative of the translational motion of a deflected flap relative to a hinge block where the flap assembly is made in accordance with the present invention and illustrating particularly how such flap translation relative to the hinge block permits rotation of the flap when deflected;

FIG. 6 is a fragmentary sectional view taken substantially along the line 6A—6A in FIG. 2, and here illustrating the positive interconnection between the trailing foil edge, the leading flap edge, and the hinge block at the inboard one of the two "hard" pivot connections between flap and foil with the flap here being shown in the nonrotated position lying in the plane of the foil, it being understood that the sectional view is equally representative of a section along the line 6B—6B in FIG. 2 at the outboard "hard" pivot connection except that the vertical scale is somewhat different at the two section lines due to thinning of the foil structure toward the tip thereof;

FIG. 7 is a sectional view taken substantially along the line 7—7 in FIG. 6 and here illustrating details of the hinge construction of the present invention at one of the two "hard" pivotal connection points;

FIG. 8 is a fragmentary sectional view taken substantially along the line 8—8 in FIG. 2, but here illustrating the trailing edge of the foil, hinge block and translatable flap lying in the plane of the foil with the view being taken substantially midway between two spaced "hard" pivot connections between flap and foil;

FIG. 9 is a sectional view similar to FIG. 7, but here taken substantially along the line 9—9 in FIG. 8 and illustrating details of the hinge construction of the present invention at a point midway between the two "hard" pivotal connection points; and, FIG. 10 is a sectional view similar to FIG. 8, but here illustrating the flap rotated with respect to a deflected foil with such rotation being accommodated by translation of the flap with respect to the rotated hinge block.

While the invention is susceptible of various modifications and alternative forms, a specific embodiment thereof has been shown by way of example in the drawings and will herein be described in detail. It should be understood, however, that it is not intended to limit the invention to the particular form disclosed but, on the contrary, the intention is to cover all modifications, equivalents and alternatives falling within the spirit and scope of the invention as expressed in the appended claims.

DETAILED DESCRIPTION

Environment of the Invention

Referring to the drawings, FIG. 1 is illustrative of a conventional hydrofoil construction and related hinge arrangement, generally indicated at 20, and of the type that might commonly be used on a "Canard" type of hydrofoil vessel (not shown). Thus, the conventonal flap/foil construction here illustrated includes a longitudinally extending foil 21 of the type adapted to be supported by a forward strut 22 and employing a multiplicity of side-by-side segmented trailing edge flaps 23R–26R and 23L–26L. In such an arrangement, and as described in greater detail in, for example, the aforesaid Roeseler et al., U.S. Pat. No. 4,213,587, Feifel, U.S. Pat. No. 4,305,177 and Warner et al., U.S. Pat. No. 4,335,671, the segmented flaps are the type adapted to be hingedly connected to the trailing edge 27 of the foil 21 at span-wise spaced points 28 of "hard" pivotal connections; there being two such "hard" pivotal connection points for each flap segment and with adjacent flap segments sharing a common "hard" hinged connection. Suitable power actuated drive means, generally indicated at 29L and 29R, are provided for driving the left and right sets of segmented flaps with keyed drive connections 30 being provided between adjacent flaps for transmitting rotational torque to the outboard flap segments 24L–26L and 24R–26R.

Referring to FIG. 2, there has been illustrated in plan form an improved hydrofoil/flap assembly, generally indicated at 40, and embodying features of the present invention. Thus, as will here be noted, the assembly 40 includes a longitudinally extending foil 41 adapted to be secured to and project laterally from a support strut 42 with the tip end 44 of the foil 41 being unsupported A single flap 45 coextensive with the trailing edge 46 of the foil is here coupled to the foil at two span-wise spaced points—here the inboard point "X" and a generally outboard point "Y". As is desirable with such flap/foil combinations 40, the leading edge 48 of the flap 45 is received within a concavity formed in the trailing edge 46 of the foil 41 so as to minimize gaps and/or discontinuities between the flap and foil along the span-wise length of the hinged connection therebetween.

Turning to FIG. 3, there has been illustrated in diagrammatic form a rear elevational view of the flap/foil combination 40 in solid lines illustrating the flap/foil deflected configuration when subjected to fluid loads as the hydrofoil vessel moves through the water; and, with the undeflected nonloaded foil being illustrated in phantom at 40'. As here shown, it will be appreciated that when the flap/foil combination 40 is in the undeflected condition indicated at 40', the unloaded hinge line is linear; and, consequently, the flap is free to pivot about all points "R" along the unloaded hinge line without flap/foil interference. However, when the flap is subjected to loads and deflected to the solid line position shown at 40, the actual hinge line becomes curvilinear. At the two points "X" and "Y" of "hard" pivotal connection between flap and foil, the actual curvilinear hinge line is coincident with a theoretical linear hinge line extending through those two points. Considering a point midway between the two span-wise "hard" pivotal connection points "X" and "Y", it will be observed that when the flap is deflected from an unloaded nondeflected position to a loaded deflected position, the hinge point "R" on the unloaded hinge line translates to the theoretical hinge point "S", while the actual hinge point translates to the point "T" located intermediate the points "R" and "S". It is this differential translational distance between the actual hinge point "T" and theoretical hinge point "S" which causes the problem of flap/foil interference when attempting to rotate the flap 45 when the foil 41 is in the deflected state. As will be apparent from FIG. 3, at the two points "X" and "Y" of "hard" pivotal connection, the actual hinge points "T" would coincide with the theorectical hinge points "S" due to intersection of the actual and theoretical hinge lines at these two points, with the degree of differential spacing between the actual and theoretical hinge lines getting progressively greater at increasing span-wise distances from a "hard" pivotal connection, point "X" or "Y" and reaching a maximum at a span-wise location located essentially midway therebetween.

In order to facilitate an understanding of the problems created when attempting to pivot a flap—e.g., flap 45 in FIG. 2—about an actual curvilinear hinge line, the kinematic considerations with respect to movement of hinge points are more particularly set forth by reference to FIGS. 4 and 5 conjointly. Thus, FIG. 4 is illustrative on a larger scale of the translation of the hinge point "R" on an unloaded hinge line to an actual hinge point "T" on the deflected hinge line at a point essentially midway between two points "X", "Y" of "hard" pivotal connection between flap and foil; and, illustrating also the differential distance between the actual hinge point "T" and the theoretical hinge point "S" lying on the theoretical straight or linear hinge line between the points "X" and "Y". Those skilled in the art will, of course, appreciate that when the flap is operated it must, due to horizontal flap stiffness, rotate about the theoretical hinge point "S". However, in order to do so without undesired flap/foil interference, it is essential that the flap be able to translate in a fore and aft direction relative to the span-wise extending hinge elements. For example, referring to FIG. 5, it will be observed that for a flap to be able to freely pivot about the theoretical hinge point "S", it is essential that the actual hinge point "T" on the flap translate (here in a forward direction) to a forwardly displaced point "$T_1$". It will, of course, be appreciated that such translational movement between the flap and the hinge element, a translational motion that will vary with flap angle, but which will get progressively less as one moves closer to a "hard" point "X" or "Y" of pivotal connection where the points "S" and "T" coincide.

Hinge Construction Embodying The Invention

With the foregoing theoretical considerations in mind, reference is now made to FIGS. 6 and 7 conjointly wherein an exemplary practical embodiment of the invention has been illustrated. Thus, it will be observed that in the present invention the foil 41 is provided with an integral comb-like hinge member 50 defining a plurality of span-wise spaced rearwardly extending hinge elements 51 projecting rearwardly from the foil trailing edge 46. A mating hinge block 52, preferably formed of flexible, high density, plastic material such as nylon, urethane, or the like, and having a low coefficient of friction or treated with suitable materials to reduce the coefficient of friction, is preferably shaped in a mating comb-like configuration defining forwardly projecting hinge elements 54 adapted to be interfit in alternating interdigitated relationship with the hinge elements 51 on comb-like member 50, with the entire hinge assembly being held together by means of a span-wise extending flexible hinge pin 55. Thus, the hinge block 52 and comb-like hinge member 50 on the trailing edge 46 of the foil 41 define a "piano hinge" construction which is coextensive with the span-wise extent of the foil trailing edge 46.

In carrying out the present invention, provision is made for securing the flap 45 to the hinge block 52 at two span wise spaced points "X" and "Y" defining "hard" pivotal connections. To accomplish this, suitable fastening means 58 are provided extending downwardly through the leading edge of the foil 45 and through the trailing edge of the hinge block 52 so as to securely lock the flap to the hinge block and provide restraint against relative movement therebetween at the two "hard" pivotal connection points "X" and "Y" shown in FIG. 2. Assuming that the flap/foil combination 40 is in the unloaded nondeflected state, those skilled in the art will readily appreciate that the entire span-wise extent of the flap 45 can be pivoted with respect to the foil trailing edge 46 by driving the flap around the unloaded hinge line defined by the hinge pin 55. And, as previously indicated, at the two points "X" and "Y" of "hard" pivotal connection, the flap 45 may still be pivoted around the pivot axis defined by hinge pin 55 since the actual hinge point "T" and theoretical hinge point "S" coincide at this point.

Considering next FIGS. 8 and 9 conjointly, there will be briefly described the relationship of the flap/foil hinge components as they exist at a point midway between the two points "X" and "Y" of "hard" pivotal connection. Thus, when the flap 45 is in the nonrotated state, the relative positions of the flap 45, foil 41, hinge block 52, slot 56 and hinge pin 55 remain essentially in the same positions as illustrated in FIG. 6 with respect to the description of those components at a point of "hard" hinged connection. However, assuming that the flap/foil combination 41/45 has been deflected due to fluid loading as the hydrofoil vessel moves through the water, then the actual hinge point "T" defined by pivot pin 55 will be spaced below the theoretical hinge point "S" located on the theoretical straight or linear hinge line as previously described in connection with FIGS. 3 and 4. In order to permit pivotal movement of the flap 45, the flap must pivot around the theoretical hinge point "S" and, in order to do so without flap/foil interference, it is essential for the flap to slide in a forward direction relative to the hinge block 52 so as to shift the actual hinge point "T" on the flap to the translated point "$T_1$" as previously described in connection with FIG. 5. Thus, referring to FIGS. 8 and 10 conjointly, it will be noted that as the flap 45 is pivoted, it moves in a forward direction relative to hinge block 51—such relative forward movement being permitted because no fastening means project throught the leading edge 48 of the flap 45 and the hinge block (52) at "soft" hinged points intermediate the "hard" hinge points "X" and "Y"; and, consequently, there is no restraint against fore and aft relative movement. Comparison of FIGS. 8 and 10 reveals that the spacing between the trailing edge 59 of the hinge block 52 and the base 60 of the slot 56 has been reduced from the dimension "a" (FIG. 8) to the dimension "b" (FIG. 10) with the difference between such dimensions being substantially equal to the linear distance between the point "T" and the translated point "$T_1$".

Thus, those skilled in the art will appreciate that the present invention readily permits the use of a single flap 45 extending along the entire span-wise extent of a foil trailing edge 46 and which is secured thereto at two span-wise spaced points "X" and "Y" of "hard" pivotal connection; yet, wherein the flap 45 is not restrained in the fore/aft direction with respect to the hinge block 52 at points intermediate the "hard" pivotal connection points "X" and "Y", as well as at points inboard and outboard thereof. Because of such lack of restraint against fore/aft relative movement between the hinge block 52 and the flap 45, it is possible to pivot the flap 45 without flap/foil interference.

Moreover, in accordance with another important feature of the invention, it will be appreciated that the snug sliding fit between the hinge block 52 and the slot 56 in the leading edge 48 of flap 45, and because of the continuous nature of the hinged connection therebetween extending the entire span-wise length of the flap/foil combination 40, an effective labyrinth-type seal is established which prevents bleeding of boundary layer fluid through the hinged connection. Such an arrangement enables the design of flap/foil combinations 40 wherein the gap between the foil trailing edge 46 and the flap leading edge 48 is less critical than would otherwise be the case in the absence of such a seal.

Thus, those skilled in the art will appreciate that there has herein been described an effective, reliable and highly efficient hinge construction which permits of ease of assembly, enables the use of a single span-wise extending flap as contrasted with the need for segmented flaps, and, consequently, minimizes the need for complex and expensive keyway driving arrangements and seals between adjacent flap segments. The arrangement permits of ease of manufacture, installation and maintenance and employs relatively few components as compared with conventional hinge constructions.

I claim as my invention:

1. A hinge and sealing device for hingedly connecting a flap to the trailing edge of a fluid foil of the type subjected to longitudinal curvilinear deflection due to fluid loading and comprising, in combination:

(a) a fluid foil having a trailing edge;

(b) means defining a first comb-like hinge member integral with said foil trailing edge and defining a first plurality of rearwardly extending longitudinally spaced hinge elements;

(c) means defining a comb-like hinge block having a longitudinally extending rectilinear trailing edge cross-section and defining a second plurality of forwardly extending longitudinally spaced hinge elements dimensioned to fit snugly between said first longitudinally spaced hinge elements and defining therewith an interdigitated linear array of said first and second hinge elements;

(d) hinge pin defining means extending longitudinally through said interdigitated first and second hinge elements;

(e) a longitudinally extending pivotable flap, said flap having a longitudinally extending forwardly directed slot formed in its leading edge having a rectilinear cross-section complementary to said rectilinear trailing edge cross-section on said hinge block defining means and adapted to receive said longitudinally extending hinge block defining means; and, (f) first and second fastener means extending vertically through said flap leading edge, said slot and said hinge block defining means at longitudinally spaced inboard and outboard points and defining at said inboard and outboard points "hard" pivotal connections between said flap and said foil for restraining relative movement between said hinge block defining means and said flap at said inboard and outboard "hard" pivotal connections while restraining only relative vertical movement between said hinge block defining means and said flap at all other points along the longitudinal extent of said hinge block defining means and said flap leading edge slot so that upon deflection of said fluid foil due to imposed fluid loading said hinge block defining means and said flap leading edge are free for relative fore/aft sliding motion at all longitudinal points along the interengaged hinge block defining means and flap leading edge slot other than at said inboard and outboard "hard" pivotal connections, thereby permitting interference-free pivoting of said flap with respect to said foil about said hinge pin irrespective of fluid load induced deflection of said foil with flap/foil interference during pivotal movement of said flap about a deflected curvilinear hinge line being accommodated by relative fore/aft slidable reception of said hinge block defining means within said slot.

2. A hinge and sealing device as set forth in claim 1 wherein said flap leading edge slot and said hinge block defining means form a longitudinally extending continuous labyrinth seal between the upper and lower surfaces of said foil and hinged flap at all operable positions of said flap for preventing bleeding of boundary layer fluid therethrough.

3. A hinge and sealing device as set forth in claims 1 or 2 wherein said fluid foil is a hydrofoil.

4. A hinge and sealing device as set forth in claims 1 or 2 wherein said first fastener means is located adjacent the inboard end of said foil and said second fastener means is located adjacent the outboard end of said foil.

5. A hinge and sealing device as set forth in claims 1 or 2 wherein said first fastener means is located adjacent the inboard end of said foil and said second fastener means is located intermediate said first fastener means and the tip of said foil.

* * * * *